United States Patent [19]

Ausman et al.

[11] 4,308,450

[45] Dec. 29, 1981

[54] TWO-PIECE SLIDE CALCULATOR FOR DETERMINING METABOLIC REQUIREMENTS AND PARENTERAL FEEDING DOSAGES

[75] Inventors: Robert K. Ausman, Long Grove; Hugh N. Tucker, Chicago, both of Ill.

[73] Assignee: Baxter Travenol Laboratories, Inc., Deerfield, Ill.

[21] Appl. No.: 972,463

[22] Filed: Dec. 22, 1978

[51] Int. Cl.[3] ..... G06G 1/02

[52] U.S. Cl. ..... 235/70 A; 235/89 R

[58] Field of Search ..... 235/70 A, 70 R, 89 R

[56] References Cited

U.S. PATENT DOCUMENTS

| | | | |
|---|---|---|---|
| 1,520,105 | 12/1924 | Bicknell | 235/70 A |
| 1,525,598 | 2/1925 | Tsuda | 235/70 A |
| 2,171,873 | 9/1939 | Gould | 235/89 R |
| 2,614,751 | 10/1952 | Heinz, Sr. | 235/89 R |
| 3,467,307 | 9/1969 | Levitt | 235/89 R |
| 3,533,551 | 10/1970 | Cole et al. | 235/89 R |
| 3,627,199 | 12/1971 | Hill | 235/85 R |
| 3,650,467 | 3/1972 | Sellie | 235/89 R |
| 3,747,847 | 7/1973 | Cohen | 235/89 R |
| 3,859,511 | 1/1975 | Walker | 235/85 R |
| 3,933,305 | 1/1976 | Murphy | 235/70 A |
| 4,120,451 | 10/1978 | Stapleton | 235/70 A |
| 4,121,759 | 10/1978 | Merkel et al. | 235/85 R |

FOREIGN PATENT DOCUMENTS

| | | | |
|---|---|---|---|
| 2152326 | 4/1972 | Fed. Rep. of Germany | 235/70 A |
| 2428058 | 1/1976 | Fed. Rep. of Germany | 235/70 A |

OTHER PUBLICATIONS

Purdue University, "Special Slide Rules", by J. Arnold, Sep. 1933, pp. 19–36.

*Primary Examiner*—L. T. Hix
*Assistant Examiner*—Benjamin R. Fuller
*Attorney, Agent, or Firm*—Paul C. Flattery; John P. Kirby, Jr.; Gerald S. Geren

[57] ABSTRACT

There is disclosed herein a slide calculator for determination of factors related to metabolic requirements and used in determining parenteral feeding dosages. By use of the calculator, factors, such as basal energy expenditure, body surface area, ideal body weight, and carbohydrate dosage can be determined.

The calculator includes a front panel and a back panel, each having several window-like apertures. A slide member is positioned and movable between the front and back panels. Indicia is provided on the front and back panels and is generally arranged adjacent the window-like apertures. Indicia is also provided on the slide member and is arranged for exposure at predetermined windows.

In connection with each of the factors to be determined, the indicia on the slide and the indicia adjacent the appropriate window are arranged in a predetermined manner and relationship so as to permit the desired factor to be determined or calculated.

16 Claims, 6 Drawing Figures

TWO-PIECE SLIDE CALCULATOR FOR DETERMINING METABOLIC REQUIREMENTS AND PARENTERAL FEEDING DOSAGES

BACKGROUND OF THE INVENTION

This invention relates to slide calculators, and in particular, to a calculator for determining factors relating to metabolic requirements and parenteral feeding dosage requirements in humans.

Intravenous nutrition is used in a large variety of medical situations, and it is therefore necessary to determine the dosage, or amount, of solution which should be given to a patient on a daily basis. The factors which may be considered in determining the dosage include the patient's age, weight, height and body surface area and the composition of the intravenous solution. The patient's age, weight, height, and body surface area are factors which are related to the energy which a patient expends. In other words, those factors can be used to determine the minimum amount of energy which a patient requires, from which dosages can be determined.

At the present time, energy requirements are not normally determined because the determination requires: (1) the use of complex mathematical equations which are not well known or readily available to medical personnel; or (2) direct or indirect measurement requires expensive analytical apparatus, significant manpower, and possibly the transport of very ill patients.

Eli Lilly & Co., many years ago, made available a three-piece slide calculator for determining caloric requirements. The calculator was intended for use in computing diets for diabetics and was similar to the normal slide rule. In other words, the calculator had a body, a movable slide and a movable cursor. Use of the calculator took into account weight, height, and age in determining energy requirements.

There also exists at the present time a large number of two-piece slide calculators for making calculations of various types. These calculators include an envelope-like structure having front and back panels and a slide member movable between the panels. These slide calculators are normally made of cardboard and are very inexpensive to produce.

It is the object of this invention to provide a slide calculator for determining basal energy expenditure, body weight, body surface area and/or carbohydrate dosage which can be made readily available to medical personnel who need to make such calculations.

Another object of the invention is to provide a slide calculator which can be inexpensively produced and can be made available at little or no cost.

These and other objects of the invention will become apparent from the following description and appended claims.

SUMMARY OF THE INVENTION

There is provided by this invention a two-piece slide calculator for determining basal energy expenditure, body surface area, body weight, and carbohydrated dosage.

The slide calculator includes an envelope-like structure having a front and back panel which are secured to one another. Each panel has at least one window-like aperture and includes indicia associated with each of said apertures. A slide member is also provided which is positioned between the front and back panels and is movable therebetween. The slide member also includes indicia thereon arranged to appear at preselected apertures and to cooperate with indicia on the front or back panels in order to permit the desired calculation.

For example, in determining basal energy expenditure, the front panel includes two apertures with indicia relating to age associated with one aperture, and indicia relating to height associated with the other aperture. The movable slide includes indicia relating to weight and energy expenditure. Indicia on the front panel and on the slide member are arranged so as to cooperate and permit alignment of age and weight indicia for determination of basal energy expenditure in relationship to the height indicia.

Other apertures and indicia are provided for determining body weight, body surface area, and carbohydrate dosage.

DESCRIPTION OF THE PREFERRED EMBODIMENT

General

Figure 1:
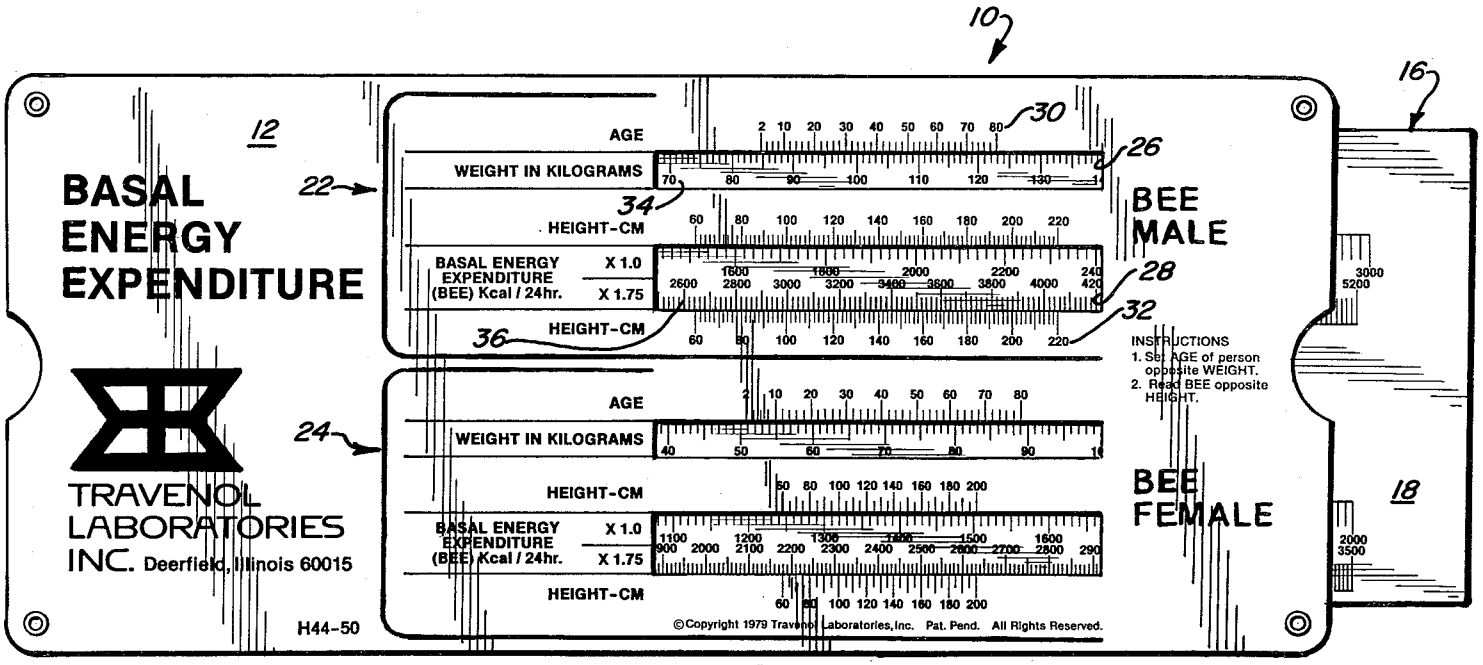
FIG. 1 is a plan view of the front panel with the slide member in position.

Referring now to the drawings, there is shown a two-piece slide calculator 10 generally. The calculator includes a front panel 12 (see FIG. 1) and a back panel 14 (see FIG. 2) which are riveted together at the corners to form an envelope-like structure. A slide member 16 is provided and is positioned between the front panel and back panel for longitudinal movement therebetween.

The slide member 16 includes front and back faces 18 and 20 for cooperation with the front and back panels 12 and 14, respectively.

The front panel 12 in cooperation with the front face 18 is used to determine basal energy expenditure (BEE). The back panel 14 and back face 20 cooperate with each other in order to determine body surface area, ideal body weight and carbohydrate dosate.

Basal Energy Expenditure

Figure 3:
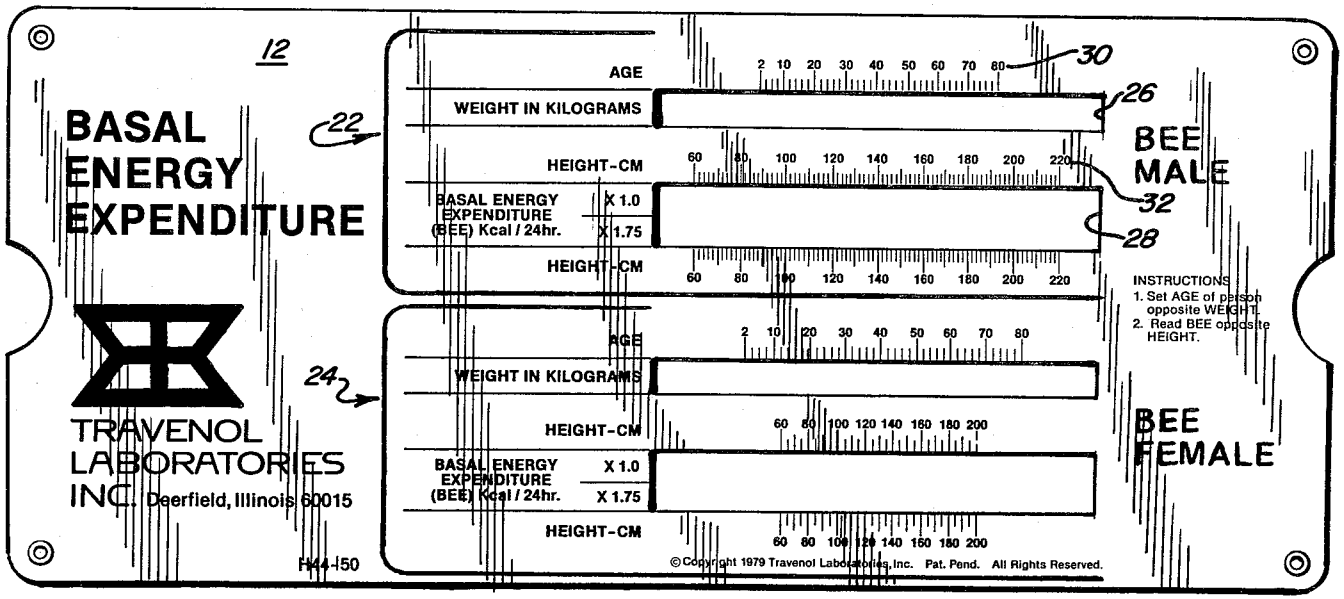
FIG. 3 is a plan view of the front panel.
Figure 4:
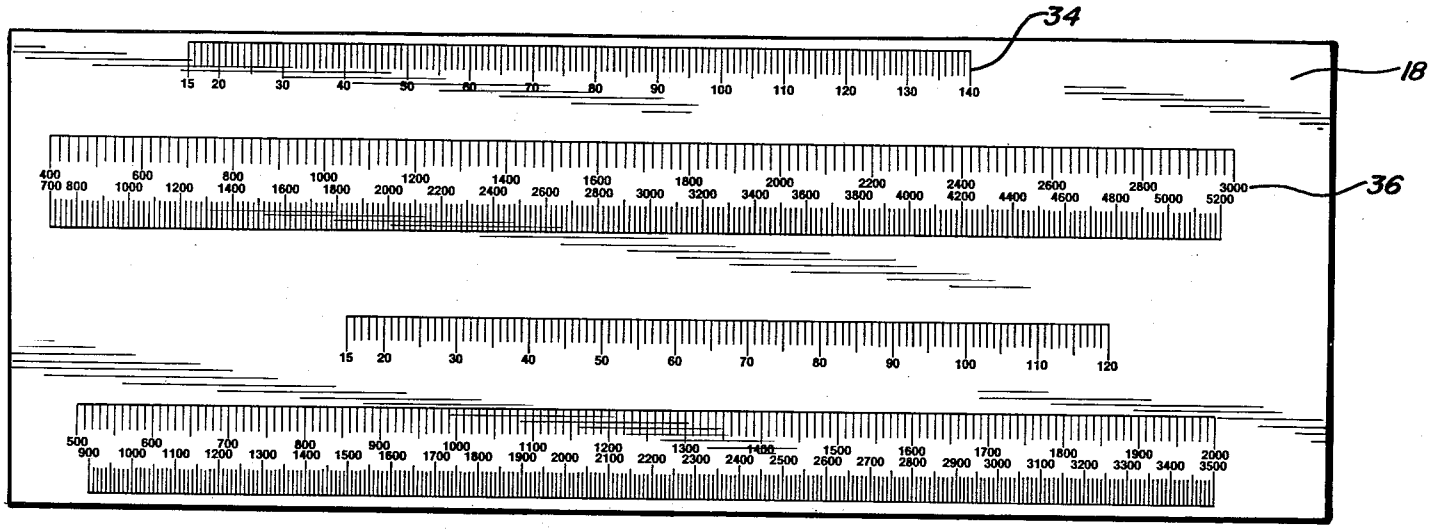
FIG. 4 is a plan view of the front side of the slide member which cooperates with the front panel member.

Referring now to FIGS. 1 and 3, the front panel 12 includes an upper portion 22 for calculating the BEE for males and a lower portion 24 for calculating BEE for females.

The factors used in determining BEE for males and females include age, weight and height, and for purposes of illustration, the BEE male section 22 will be discussed.

The upper section 22 for calculating BEE for males includes an upper weight exposing window 26 and a lower BEE exposing window 28.

Window 26 is labeled "Weight in Kilograms", and the window 28 is labeled "Basal Energy Expenditure (BEE) Kcal/24 hours". The BEE window includes an upper portion labeled "×1" and a lower window "×1.75". In making these calculations, some medical personnel prefer to know the direct calculation, while others prefer to use 1.75×BEE, which is indicative of energy requirements for post-operative conditions. Positioned above the upper window 26 is a linear age scale 30 which extends from two to eighty years of age. Positioned above and below the energy expenditure window 28 is a linear height scale 32, showing patient's height between 60 and 220 centimeters.

The front face 18 of the slide member 16 includes a linear weight scale 34 showing patient's weight ranging from 15 to 140 kilograms.

Below the weight scale there is provided a BEE scale 36 having an upper portion and a lower portion. The upper portion is linear and expresses BEE in Kcal/24 hours×1, while the lower scale is also linear but expresses Kcal/24 hours×1.75. The upper scale extends between 400 and 3000 kilocalories per 24 hours (Kcal/24 hours), and the lower scale between 700 and 5200 Kcal/24 hours. The positioning of the upper and lower portions of the BEE scales relative to each other can easily be seen by noting: that 1000 on the upper scale is opposite 1750 on the lower scale; and that 2000 on the upper scale is opposite 3500 on the lower scale.

The weight scale 34 is positioned for exposure in the upper window 26, and the scale 36 is positioned for exposure in the lower window 28.

Scales 34 and 36 on the slide member, as well as scales 30 and 32 on the face member are positioned in predetermined manner. The extent to which each of these scales is expanded or contracted and the positioning of the scales relative to each other are empirically determined in accordance with the standard method of determining BEE and the physical size of the calculator.

For males, the equation for determining BEE is as follows:

$$BEE = 66.5 + (13.8 \times \text{weight}) + (5.0 \times \text{height}) - (6.8 \times \text{age})$$

Weight in kg  Height in cm  Age in years

This equation governs the size and positioning of the scales relative to one another.

Referring now to FIG. 1, a BEE determination is made by (1) moving the slide member 16 so as to set the weight of the patient opposite his age and (2) then reading the BEE opposite the height. For example, if a patient's age is 52 and his weight were 110 kilograms, then 110 kilograms from scale 34 would be set opposite his age 52 from scale 30. If that patient's height were 150 centimeters, then the BEE would be approxiately 1920 Kcal/24 hours. Using the multiplier 1.75 and reading from the bottom height scale, the BEE would be approximately 3350 Kcal/24 hours.

By manipulating the front face 18 of the slide 16 relative to the front panel 12 so as to align the respective scales, the BEE calculation for men can easily be made.

In connection with females, the same factors are used, except that BEE for females is determined by the following formula:

$$BEE = 655.1 + (9.6 \times \text{weight}) + (1.8 \times \text{height}) - (4.7 \times \text{age})$$

Weight in kg  Height in cm  Age in years

The difference in the equation as between male and female causes the differences in the expansion or contraction and relative positioning of the age, weight, height and energy expenditure scales as shown on the front panel 12 and front face 18. It is not deemed to be necessary to repeat the discussion relative to those additional scales as it is believed that the description as related to the positioning and size of the scales as related to males is sufficient to also explain the nature, positioning and operation of the scales for females.

Body Surface Area

Figure 5:
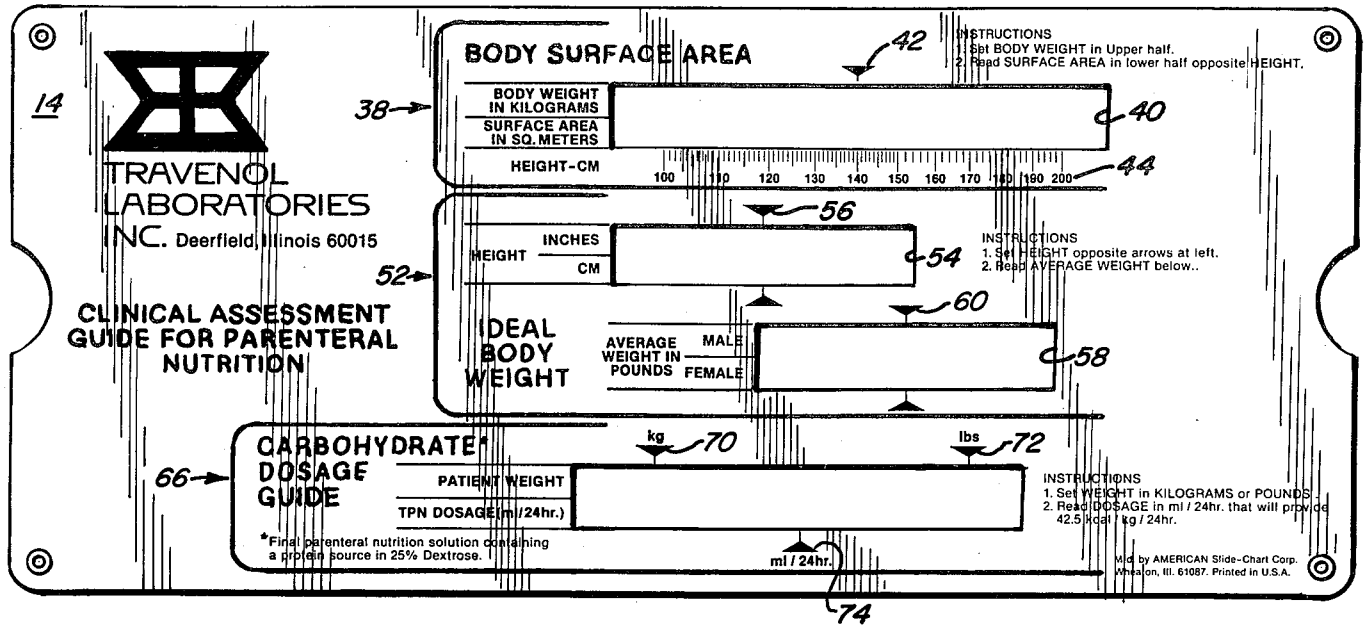
FIG. 5 is a plan view of the back panel.
Figure 6:
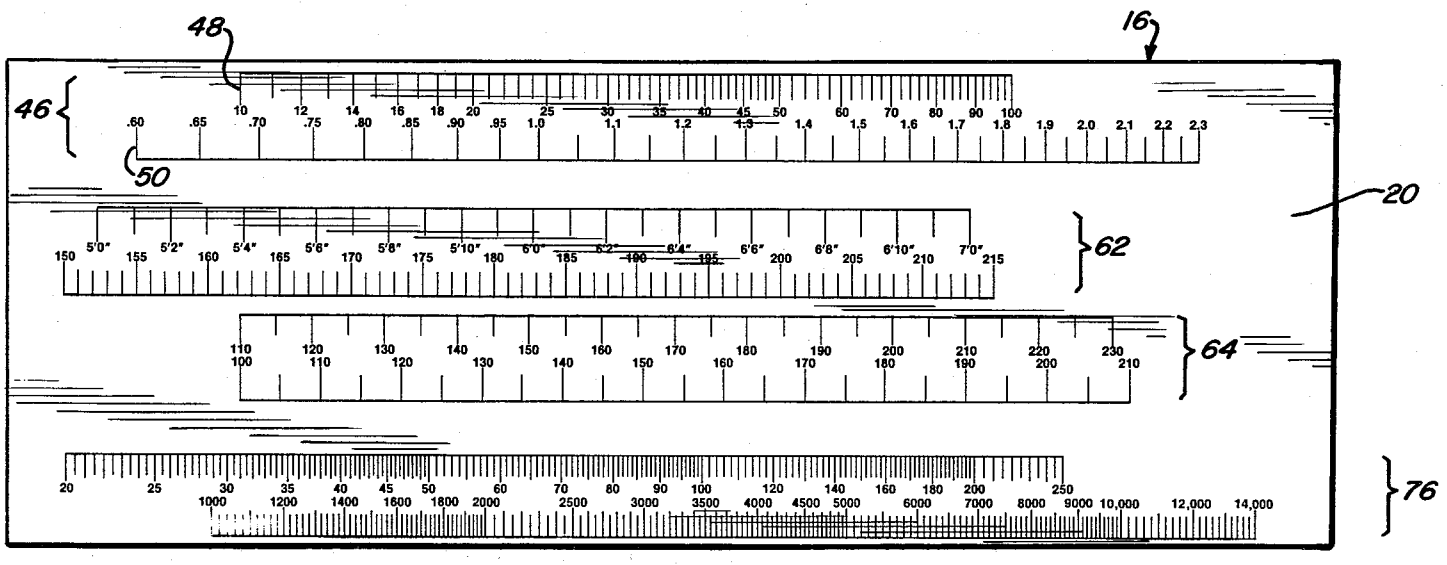
FIG. 6 is a plan view of the back side of the slide member which cooperates with the back panel member.

Referring now to the back panel 14 and the back face 20 of the slide member 16 as shown in FIGS. 5 and 6, the upper portion includes a section for calculating body surface area. The body surface area section 38 on the back panel 14 includes a single window 40, and the upper half of the window is designated as body weight in kilograms and the lower half is designated as surface area in centimeters. An arrow-like indicator 42 is positioned above the window and a logarithmic height scale 44 in centimeters is provided below the window. The scale extends from 100 to 200 centimeters.

Referring to FIG. 6, the slide member 16 includes an upper section 46 having an upper logarithmic scale 48 for body weight in kilograms and a lower logarithmic scale 50 which expresses surface body areas in square meters.

Figure 2:
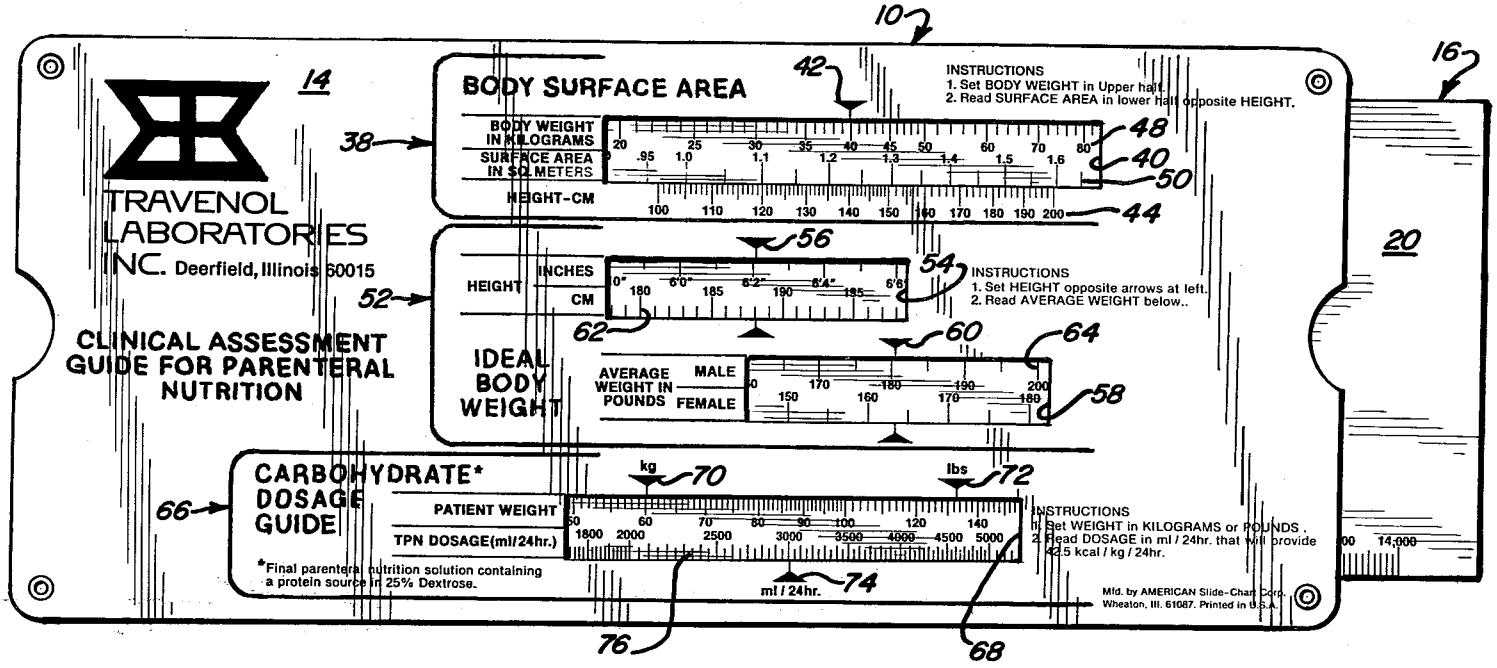
FIG. 2 is a plan view of the back panel with the slide member in position.

A sample calculation for body surface area is shown in FIG. 2. In order to make the calculation, the body weight as appearing on the slide member is set opposite the indicator arrow 42. Then the height of the patient is noted and the body surface area is determined opposite the height. For example, for a person having a body weight of approximately 40 kilograms and whose height is 151 centimeters, the body surface area is shown to be 1.3 square meters.

The positioning and size of the scales are determined by the formula:

$$\text{LOG } SA = (\log W) \times (0.425) + (\log H) \times (0.725) + 1.8564$$

Log $SA$ in cm$^2$  $W$ = wt. in kg  $H$ = ht. in cm

The antilog of log surface area as determined by the formula is in square centimeters and is properly adjusted so as to be expressed in square meters as appears on the calculator.

Ideal Body Weight

A center section 52 is provided on the back panel 14 for determining ideal body weight.

Referring to the panel 14 as shown in FIG. 5, the ideal body weight section includes an upper window 54 which carries the identification "Height" with inches expressed in the upper half of the window and centimeters in the lower half. Indicators, such as 56, are provided above and below the window. The section 52 also includes a lower window 58 for determining the average weight in pounds. That window is labeled in the upper portion "Male" and in the lower portion "Female" and also carries an indicator arrow 60.

Referring now to FIG. 6 and the back face of the slide member 16, the scales 62 and 64 are shown. The scale 62 is a linear height scale with the upper portion being in inches and ranging from 5 feet 0 inches to 7 feet 7 inches, and the lower portion in centimeters and ranging from 150 to 215 centimeters. The lower scale 64 is for weight, is linear and includes an upper portion which expresses the weight for males as ranging between 110 and 230 pounds, and the lower portion is for females and expresses weights as ranging between 100 to 210 pounds.

In operation, the height scale 62 appears in window 54, and the weight scale 64 appears in window 58. A typical calculation is shown in FIG. 2 where the height, set opposite the indicator 56, is approximately 6 feet 2 inches and the weight of a male is read opposite the indicator 60 as approximately 181 pounds. For a female of the same height, the weight is read opposite the lower indicator as approximately 164 pounds.

The ideal body weight is determined from the following formulas:

Ideal weight male = 110 pounds + (5 pounds/inch of height over 5 feet)

Ideal weight female = 100 pounds + (4.5 pounds/inch of height over 5 feet)

The scales 62 and 64, as well as the indicators 56 and 60 are set relative to one another based upon the foregoing formula.

Carbohydrate Dosage

The bottommost section 66 on the back panel 14 is used in determining carbohydrate dosage. This particular calculator assumes the use of a parenteral solution containing 25 percent dextrose (i.e., 25 grams of dextrose/100 ml of water).

The lower section 66 includes a window 68 which is labeled in its upper portion as patient weight and in its lower portion as TPN dosage (ml/24 hours). Two indicator arrows 70 and 72 are provided above the window for indicating patient weight in kilograms (70) and in pounds (72). A lower indicator arrow 74 is provided for identifying the dosage as expressed in milliliters of solution per 24 hours.

Referring now to the back face 20 of the slide 16 as shown in FIG. 6, there is shown a pair of lower scales 76. The upper portion of the scale 76 is logarithmic and identifies patient's weight as between 20 and 250 units. The lower scale indicates dosage, is logarithmic and ranges from 1000 to 14,000 ml/24 hours. In order to make determinations of the carbohydrate dosage for a 25 percent dextrose solution, the patient's weight is calculated or otherwise determined and is set opposite the appropriate indicator.

As shown in FIG. 2, a body weight of approximately 60 is set opposite the kilogram indicator 70, and by reading opposite the dosage indicator arrow 74, it is determined that the approximate carbohydrate dosage is approximately 3000 ml/24 hours.

The dosages provide 42.5 Kcal/kg of body weight/24 hours.

The relationship of the indicators 70 and 72 to the indicator 74 and the scales 76 to each other are determined by the empirical formula dosage:

$$\text{Ml/24 hours} = 50 \times \text{patient weight in kilograms}$$

The constant, 50, is determined with relationship to the composition of the solution used. In other words, 50 is related to the 25 percent dextrose solution. Other constants can be determined for solutions having other compositions.

From the foregoing, it is seen that a simple two-piece calculator is provided for determining BEE, body surface area, ideal body weight and carbohydrate dosage in an inexpensive, quick and accurate manner.

It will also be appreciated that modifications can be made to the embodiment shown herein without departing from the spirit and scope of this invention.

What is claimed is:

1. A two-piece slide calculator for determining basal energy expenditure (BEE) which includes: a panel member having at least two window-like apertures and indicia associated with each of said apertures and a slide member cooperatively associated with said panel member and movable with respect thereto and having indicia thereon arranged to appear at said apertures and for alignment with the indicia associated with said panel member; wherein the indicia on said panel member includes two scales, one for age and the other for height; and the indicia on said slide member includes two scales, each for exposure at one of said windows and for cooperative positioning relative to said age and height scales, one of said slide scales representing weight and arranged for cooperation with said age scale and the other of said slide scales representing basal energy expenditure and arranged for cooperation with said height scale so that basal energy expenditure can be determined from age, weight and height.

2. A two-piece slide calculator as in claim 1, wherein the relative positioning of each of said age, height, weight and energy expenditure scales, for males, is determined by the expression:

$$\text{BEE} = 66.5 + (13.8 \times \text{weight}) + (5.0 \times \text{height}) - (6.8 \times \text{age}).$$

3. A two-piece slide calculator as in claim 2, wherein the relative positioning of each of said age, height, weight and energy expenditure scales, for females, is determined by the expression:

$$\text{BEE} = 655.1 + (9.6 \times \text{weight}) + (1.8 \times \text{height}) - (4.7 \times \text{age}).$$

4. A two-piece slide calculator as in claim 1, wherein said slide member further includes scale indicia representing BEE × 1.75 and said window-like aperture includes indicia identifying a portion of said window as BEE × 1.75.

5. A two-piece slide calculator for determining body surface area (SA) which includes: a panel member having a single window-like aperture and indicia associated therewith, said indicia including an indicator arrow positioned along one edge of said window and a height scale positioned along an opposite edge of said window and with indicia identifying body weight in kilograms for one portion of the window and indicia identifying body surface area for the other portion of said window; and a slide member having scale indicia thereon representing body weight in kilograms and surface area; said slide member being cooperatively associated with panel member and movable with respect thereto and scale indicia on slide member arranged to appear in said window-like aperture and said weight scale being alignable with said indicator indicia and said surface area being alignable with said height scale indicia so that body surface area can be determined from a patient's height and body weight.

6. A two-piece slide calculator as in claim 5, wherein the relative positioning of said indicator arrow and said height, body weight and surface area indicia is determined by the expression:

$$\text{LOG SA} = (\log W) \times (0.425) + (\log H) \times (0.725) + 1.8564$$

wherein log SA is in $cm^2$; W is in kg; and H is in cm.

7. A two-piece slide calculator for determining ideal body weight which includes: a panel member having at least two window-like apertures and indicator indicia associated with each of said apertures; one of said apertures being identified as height and the other of said apertures being identified as weight; and a slide member cooperatively associated with said panel member movable with respect thereto and having scale indicia thereon representing height and representing weight, said height indicia being arranged to appear in said height aperture and said weight indicia arranged to appear in said weight aperture so that the weight of a patient will be aligned with the weight indicia when the patient's height is aligned opposite the height indicator.

8. A two-piece slide calculator as in claim 7, wherein the relative positioning of said height and weight scales and said indicator indicia are determined for males by the expression:

Weight = 110 lbs. + (5 lbs./inch over 5 feet).

9. A two-piece slide calculator as in claim 7, wherein the relative positioning of the indicators and weight and height indicia for females is determined by the expression:

Weight = 100 lbs. + (4.5 lbs/inch over 5 feet).

10. A two-piece slide calculator for determining carbohydrate dosage of a parenteral solution, said calculator including: a panel member having a window-like aperture and weight-indicator indicia along one edge thereof and dosage-indicator indicia along the other edge thereof, with indicia for identifying one portion of the aperture as related to weight and the other to dosage; and a slide member cooperatively associated with said panel member and movable with respect thereto, and having scale indicia thereon for alignment with said indicator indicia associated with said panel member, wherein the indicia on said slide member includes two scales, one representing weight and the other dosage, said weight scale arranged to appear in said aperture for alignment with said weight indicator so that the dosage is aligned with the dosage indicator.

11. A two-piece calculator as in claim 10, wherein the relative positioning of each of said weight and dosage scales and weight and dosage indicators is determined by the expression:

Dosage = C × weight in kg; with C being a constant.

12. A two-piece slide calculator as in claim 11, wherein C = 50 and said dosage for a 25 percent dextrose parenteral solution which will provide about 42.5 Kcal/kg of body weight/24 hours.

13. A two-piece slide calculator as in claim 1, wherein:

(a) the age scale on said panel member is linear, includes a range of ages from about 2 to about 80 years and is positioned on said panel adjacent one of said window means;

(b) the height scale is linear and includes a range of heights between about 60 and 220 centimeters;

(c) the weight scale is arranged for exposure in the aperture with which said age scale is associated, said weight scale being linear, including the range of weights between about 15 and 140 kilograms, said weight scale being substantially greater in length than said age scale, and said values on said weight scale adapted for alignment with values on said age scale;

(d) the basal energy expenditure (BEE) scale being linear and expressing BEE in kilograms per 24 hours; said scale arranged to appear in the aperture with which said height scale is associated; and said BEE scale having a length greater than the length of said weight scale;

(e) whereby a patient's age and weight can be aligned by moving the slide to a position where those values are opposite one another and whereby the BEE for that patient is aligned opposite the patient's height on the height scale.

14. A two-piece slide calculator as in claim 5, wherein:

(a) the height scale is logarithmic and represents height in centimeters in the range of between about 100 to 200 centimeters;

(b) the body weight scale is logarithmic, represents body weight in the range of between about 10 to 100 kilograms, is arranged for positioning in said window and opposite said indicator level; and said body weight scale has a length greater than said height scale; and (c) the surface area scale is logarithmic, expresses surface area in square centimeters in the range of between about 0.60 to 2.3, and is arranged for cooperatively positioning relative to said height scale and is of a length greater than the body weight scale.

15. A two-piece slide calculator as in claim 7, wherein said height scale includes an upper and lower portion, with one portion expressing height in English units and the other expressing height in metric units; said English units being in the range of between about 5 feet 0 inches to 7 feet 0 inches and said metric unit being in the range of between about 150 and 215 centimeters; each of said scales being linear and arranged relative to each other so that equivalent heights are positioned opposite each other; and wherein said weight scales are positioned relative to said height scales, are linear and expresses weight between 100 and 230 pounds.

16. A two-piece slide calculator as in claim 10, wherein said weight scale is logarithmic and is expressed in units having values in the range of between about 20 to 250; and said dosage scale is logarithmic and extends from 1000 to 14,000; said scales being positioned relative to one another so as to permit calculation of dosage by employing said indicia.

* * * * *